United States Patent [19]

Kudo et al.

[11] 4,298,381

[45] Nov. 3, 1981

[54] ABRASION-RESISTIVE HIGH PERMEABILITY MAGNETIC ALLOY

[75] Inventors: Mitsuhiro Kudo, Hamuramachi; Shigekazu Otomo, Hachioji; Hirotomo Ogihara, Sendai; Yoshio Aoki, Hachioji, all of Japan

[73] Assignee: Hitachi Denshi Kabushiki Kaisha, Tokyo, Japan

[21] Appl. No.: 104,716

[22] Filed: Dec. 18, 1979

[30] Foreign Application Priority Data

Dec. 22, 1978 [JP] Japan ..... 53-157602

[51] Int. Cl.[3] ..... C22C 38/06

[52] U.S. Cl. ..... 75/124; 148/121; 148/112; 148/31.55

[58] Field of Search ..... 75/124 E, 124 F, 123 D, 75/123 L, 123 M, 126 D, 126 K, 126 Q; 148/31.55, 121, 122, 100, 102, 111, 112, 113, 31.57; 360/125

[56] References Cited

U.S. PATENT DOCUMENTS

| | | | |
|---|---|---|---|
| 3,999,216 | 12/1976 | Berchtold | 148/31.57 |
| 4,065,330 | 12/1977 | Masumoto et al. | 148/100 |
| 4,168,187 | 9/1979 | Takayanagi et al. | 75/124 |

*Primary Examiner*—L. Dewayne Rutledge
*Assistant Examiner*—John P. Sheehan
*Attorney, Agent, or Firm*—Craig and Antonelli

[57] ABSTRACT

Abrasion-resistive, high permeability magnetic alloy consisting essentially of 6–9 wt. % of Si, 7–11 wt. % of Al, 2–5 wt. % of Cr, 0.05–2 wt. % of Ti, 0.02–0.3 wt. % of at least one member selected from P and C, and the balance of Fe. The alloy is suitable as a core material for a magnetic head.

4 Claims, 4 Drawing Figures

ABRASION-RESISTIVE HIGH PERMEABILITY MAGNETIC ALLOY

BACKGROUND OF THE INVENTION

1. Field of the Invention

This invention relates to an abrasion-resistive high permeability magnetic alloy for a magnetic head and more specifically to a Fe-Al-Si type alloy having improved magnetic properties and to a method for effecting the heat-treatment of the alloy. Further, the present invention relates to a magnetic head usind said alloy.

2. Brief Description of the Prior Art

As materials for magnetic recording and playback heads in analog and digital magnetic recording, there have, to this date, been used primarily permalloy and sen-alloy as the materials of a metal type and Mn-Zn ferrite and Ni-Zn ferrite as the materials of a ferrite type. However, the former exhibits a problem in its abrasion resistivity while the latter has low saturation magnetic flux density and is not free from the problem of the occurrence of noise inherent to the ferrite.

An alloy consisting of 8–11 wt.% of Si,4–7 wt.% of Al and the balance of Fe is referred to as a 37 sen-alloy" and has excellent magnetic properties such as high permeability and high saturation magnetic flux density so that the material is believed to be a promising core material for a magnetic head. However, further improvement of this material in its abrasion resistivity is necessary in order to put the material into practical use. Many attempts have therfore been made heretofore to improve the abrasion resistivity of such materials by adding Ti, Ge, Zr, Cu, Nb, Ta, Ni, Cr, Co, W, Mo, Hf and rare earth elements to a Fe-Al-Si alloy as the principal component.

When the abrasion resistivity is improved by the addition of these elements, however, the magnetic property of the sen-alloy tends to be lowered. If a composition is selected which will prevent degradation of the magnetic property on the contrary, remarkable improvement in the abrasion resistivity can not be expected. Hence, the above-mentioned attempts are not yet entirely satisfactory.

The following references are cited to show the state of the art;

(1) Japanese Patent Laid-Open No. 110,925/1975
(2) Japanese Patent Laid-Open No. 56,397/1977
(3) Japanese Patent Laid-Open No. 21,031/1978

SUMMARY OF THE INVENTION

The present invention provides a high permeability magnetic alloy having improved abrasion resistivity and improved magnetic properties which solves the above-mentioned problems of the high permeability alloys in accordance with the prior art, provides the most optimum method of the heat treatment of said alloy and also provides an improved magnetic head using said alloy.

The abrasion-resistive high permeability magnetic alloy in accordance with the present invention which will satisfy the above-mentioned objects has a composition consisting essentially of 6–9 wt.% of Si, 7–11 wt.% of Al, 2–5 wt.% of Cr, 0.5–2 wt.% of Ti, 0.02–0.3 wt.% of at least one element selected from P and C, and the balance of Fe. The expression "wt.%" will hereinafter be called "%" for the sake of brevity.

As mentioned above, in the alloy in accordance with the present invention, the addition of Cr and Ti in suitable amounts to the composition of the Fe-Al-Si alloy improves the abrasion resistivity, and the amounts of Al and Si are optimized by deviating these amounts from the optimum amounts of the conventional sen-alloy so as to cope with reduction of the magnetic properties due to the addition of Cr and Ti. Further, both, or either of, P and C is added to prevent degradation of the magnetic properties or to rather improve the same. When the above-mentioned Fe-Al-Si-Cr-Ti alloy containing P or C or both of P and C is subjected to the most optimum heat treatment, there are obtained excellent magnetic properties, and when a process for producing a magnetic head is employed which will not deteriorate this optimum heat treatment, there is obtained a magnetic head which has better magnetic performance and higher abrasion resistivity than those of the conventional magnetic head produced from the conventional sen-alloy.

The criticality of the make-up of the alloy composition is explained in the following manner.

When only Cr is added to the Fe-Al-Si alloy, its Vickers hardness tends to lower, that is, about 450 kg/mm$^2$ in comparison with about 500 kg/mm$^2$ of the conventional sen-alloy, thereby improving machinability. As to the abrasion resistivity, which consists of both effects of so-called abrasive wear and corrosive wear, the addition of Cr is effective for preventing corrosive wear in the atmosphere of high relative humidity. However, since the hardness of the resulting alloy is low, the addition of Cr alone is neither effective for so-called abrasive wear, nor for improving the magnetic properties.

When only Ti is added to the Fe-Al-Si alloy, on the other hand, the Vickers hardness is markedly improved to as high as at least 520 kg/mm$^2$ and the abrasive wear is reduced extremely. However, hardly any remarkable effect is observed in improving the corrosive wear.

When P or C alone or both of P and C are added to the Fe-Al-Si alloy, it has been found that some improvement can be observed in the magnetic properties and the hardness is also improved to some extent when the amounts of addition are limited.

Next, an attempt was made to obtain an abrasion-resistive high permeability magnetic alloy which is highly resistant both to the corrosive wear and to the abrasive wear and which has improved magnetic properties while having suitable hardness and retaining suitable machinability, by selecting suitable amounts of Cr, Ti or P or C in combination with each other and adding them to the Fe-Al-Si alloy. In other words, investigation is made first about the most optimum amounts of Al and Si and then of the most suitable amounts of addition of Cr, Ti and P or C to find out an alloy composition having excellent magnetic properties, highly resistive both to the abrasive wear and to the corrosive wear and suitable as a core material of a magnetic head in a Fe-Al-Si-Cr-Ti-P alloy or in a Fe-Al-Si-Cr-Ti-C alloy, and also to find out a method of the heat-treatment of such an alloy.

The heat-treatment condition suited for the abrasion-resistive high permeability magnetic alloy having the above-mentioned composition of the present invention comprised the steps of heating the alloy at a temperature ranging from 850° C. to 1, 100° C. for 0.5–3 hours in a non-oxidizing atmosphere and cooling the alloy at a cooling rate of at least 300° C./hour. The abrasion quantity of the alloy of the present invention is especially small at the cooling rate of 300° C./hr and it is not lowered much even when the cooling rate is increased to exceed 300° C./hr. From the practical point of view, therefore, the cooling rate sufficiently falls within the range of 300–10,000° C./hr. The cooling rate of 10,000° C./hr is comparable to air-cooling from 1,000° C.

As a result of the heat-treatment condition of the alloy of the present invention, it has been found necessary to employ the most optimum heat-treatment condition in order to improve the abrasive resistivity as well as the magnetic properties of the alloy of the present invention. In the case of the six-element alloy consisting of Fe-Al-Si-Cr-Ti-P or Fe-Al-Si-Cr-Ti-C, significant influences are extended over the abrasion resistivity and the magnetic performance of the alloy by the amounts of precipitates, shapes of the precipitates, the state of precipitation, i.e., localized precipitation or continuous precipitation, etc. which vary depending on the heat-treatment conditions. Moreover, these influences on the abrasion resistivity and the magnetic performance of the alloy also vary depending on the heat-treatment conditions during production steps of magnetic head (e.g., the temperature at the time of forming a gap) below 1,100° C. and the cooling rate, within the above-mentioned range.

When a magnetic head using as the core the alloy of the present invention which is heat-treated in the above-mentioned manner is employed as a video head for broadcasting use, it not only has sufficient magnetic recording and playback characteristics but also exhibits remarkably extended service life in comparison with a video head using the conventional sen-alloy.

DESCRIPTION OF THE PREFERRED EMBODIMENTS

Example 1

Figure 1:
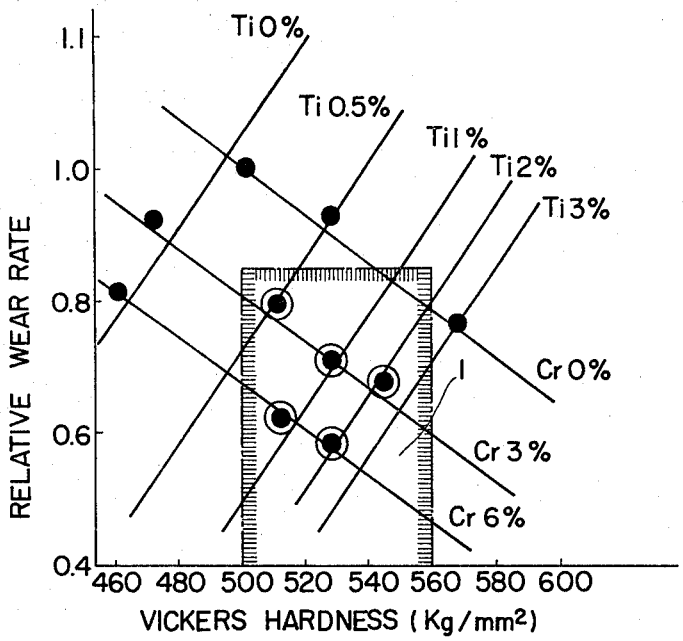
FIG. 1 is a chart showing the relation between the Vickers hardness and the abrasion quantity of the magnetic tape using a Fe-Al-Si-Cr-Ti-P alloy with varying Cr and Ti amounts.

Fe-Al-Si-P-Cr-Ti alloys are melted and casted by using 7.5% of Si, 9% of Al and 0.1% of P and by varying the amounts of Cr in the range of 0–6% and Ti in the range of 0–3% with the balance of Fe. A rectangular plate sample having the same shape and size as a piece of a head core (2 mm. wide, 3 mm. long and 0.25 mm. thick) is produced from each alloy and heat-treated at 1,000° C. for 2 hours in a hydrogen atmosphere, followed by cooling at a cooling rate of 500° C./hr. FIG. 1 illustrates the Vickers hardness of these heat-treated samples and the results of the abrasion test of the head by means of a magnetic tape ($\gamma$-$Fe_2O_3$ powder coated tape). The abrasion test by the magnetic tape is carried out at a relative humidity of 75%±3% and at a temperature of 27° C.±3° C. for 50 hours. The quantity of abrasion (abrasion quality) is expressed in terms of relative wear rate with the quantity of abrasion of the ordinary sen-alloy being at a wear rate of 1.0.

The greater the Vickers hardness, the smaller the quantity of abrasion due to the magnetic tape. When the Vickers hardness exceeds 560 kg/mm$^2$, however, machining become extremely difficult, thereby providing smaller advantages in the industrial application of the sample. When the Vickers hardness becomes below 500 kg/mm$^2$, on the other hand, some samples exhibit the tendency to increase the quantity of abrasion; hence, such hardness is not preferable. As a value of the relative wear rate which is significantly smaller than that of the sen-alloy, therefore, the value of about 0.85 is thereby selected.

Upon investigation, the optimum amounts of composite addition of Cr and Ti within the limited ranges of the relative wear rate of not greater than 0.85 and the Vickers hardness of from 500 to 560 is found to fall within the range 1 encompassed by dot-and-chain line in FIG. 1, that is to say, within the range where Cr is from 2 to 5% and Ti is from 0.5 to 2%.

To examine the magnetic properties of the alloys falling within the above-mentioned range, a ring-like sample having an outer diameter of 5 mm., an inner diameter of 3 mm. and a thickness of 0.3 mm. is cut out from each of the aforementioned casted materials and is subjected to the same heat-treatment as above. As a result of measurement, it has been confirmed that each ring-like sample has saturation magnetic flux density of 5,000–10,000 Gauss, coercive force of 0.02–0.05 Oersted and effective permeability of 9,000–12,000 at 1 KHz. That is, each sample has magnetic properties substantially equal or superior to that of the sen-alloy and has sufficient properties to serve as a magnetic head core material. Though these properties can be obtained when Si is in the range of 6–9% and Al in the range of 7–11%, the magnetic properties as a magnetic head core material would be degraded to some extent when Si is below 5% or higher than 10%, Al is below 6% or higher than 12%, Cr is higher than 6% and Ti is higher than 3%, because the saturation magnetic flux density as well as the effective permeability decrease; whereas the coercive force increases.

Example 2

Figure 2:
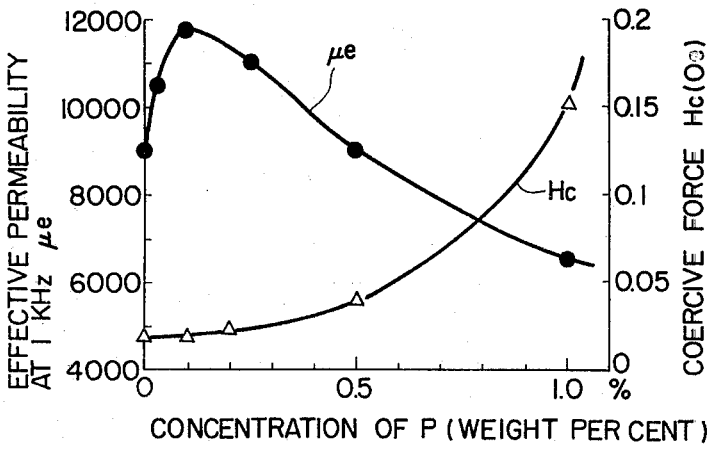
FIG. 2 is a chart showing the relation between the P amount and the magnetic performance in a Fe-Al-Si-Cr-Ti-P alloy.

Among the alloys having the composition mentioned in Example 1, an alloy composition containing 7.5% of Si, 9% of Al, 3% of Cr and 1% of Ti and the balance of Fe, which has both excellent abrasion resistivity and magnetic properties, is selected. Fe-Al-Si-Cr-Ti-P alloys are then produced by adding P to this alloy composition while varying the P amount in the range of 0–1% with the balance of Fe. A ring-like sample is cut out from each of these alloys and is heat-treated in the same way as in Example 1. The effect of addition of P is examined by measuring the magnetic properties of each ring-like sample thus produced with the results shown in FIG. 2. This drawing illustrates the relation between the effective permeability $\mu e$ and coercive force Hc versus the amount of addition of P. When the amount of addition of P is as great as 1%, the coercive force is drastically increased while the effective permeability is reduced. When the amount of addition of P is about 0.1%, the coercive force is as small as 0.02 Oersted and yet, the effective permeability is rather increased. The range of P, which ensures the coercive force of up to 0.05 Oersted and the effective permeability of at least 9,000, is from 0 to 0.5%. However, when the amounts of Al, Si, Cr and Ti are so limited as to fall within the aforementioned range of composition, the range of the amount of addition of P is narrowed. For example, in the case of the alloy composition containing 7.5% of Si, 9% of Al, 5.8% of Cr, 2% of Ti and the balance of Fe, the effective permeability at 1 kHz is 8,000, but it is 9,000 when 0.02% of P is added. It has thus been confirmed that the optimum amount of P is in the range of 0.02–0.3%.

EXAMPLE 3

Experiments are carried out in the same way as in Example 2 except that C is added in place of P. Substantially the same effects are observed as were observed with the addition of P when C is added in place of P. It has been confirmed that the optimum amount of addition of C is in the range of 0.02–0.3%. When, for example, a ring-like sample is cut out from a Fe-Al-Si-Cr-Ti-C alloy consisting of 7.0% of Si, 9.5% of Al, 2% of Cr, 2% of Ti, 0.1% of C and the balance of Fe and is then heat-treated in the same way as in Example 1, the sample is found to have the magnetic properties, i.e., saturation magnetic flux density of 8,000 Gauss, coercive force of 0.04 Oersted and effective permeability of 10,000 at 1 KHz. The relative wear rate is found to be 0.75 as a result of the abrasion test using a dummy head having a similar shape to that of the head of Example 1. The similar effect can be obtained when P and C are jointly added within the range of 0.02–0.3% in total of P and C.

EXAMPLE 4

Ring-like samples are cut out from casted materials having the compositions (weight ratio) shown in Table 1 below and are subjected to the heat-treatment in the same way as above-mentioned Examples. The magnetic properties of each sample is shown in Table 1 where Hc represents the coercive force (Oe) and $\mu e$ 1 KHz represents the effective permeability at 1 KHz. From the results shown in Table 1, it can be seen that the amount of Al is in the range of 7–11% and the amount of Si is in the range of 6–9%.

TABLE 1

| Sample No. | Composition | Hc | $\mu e$1 KHz |
|---|---|---|---|
| 1 | $Fe_{80.4}Si_{6.5}Al_{9.0}Cr_{3.0}Ti_{1.0}P_{0.1}$ | 0.045 | 9,000 |
| 2 | $Fe_{79.4}Si_{7.5}Al_{9.0}Cr_{3.0}Ti_{1.0}P_{0.1}$ | 0.02 | 12,000 |
| 3 | $Fe_{79.4}Si_{8.5}Al_{8.0}Cr_{3.0}Ti_{1.0}P_{0.1}$ | 0.05 | 9,600 |
| 4 | $Fe_{80.4}Si_{8.0}Al_{7.5}Cr_{3.0}Ti_{1.0}P_{0.1}$ | 0.05 | 9,000 |
| 5 | $Fe_{78.0}Si_{6.5}Al_{10.5}Cr_{3.0}Ti_{1.0}P_{0.1}$ | 0.04 | 10,800 |
| 6 | $Fe_{79.3}Si_{7.5}Al_{9.0}Cr_{3.0}Ti_{1.0}C_{0.2}$ | 0.04 | 10,500 |
| 7 | $Fe_{79.45}Si_{7.5}Al_{9.0}Cr_{3.0}Ti_{1.0}C_{0.05}$ | 0.03 | 11,000 |

EXAMPLE 5

Figure 3:
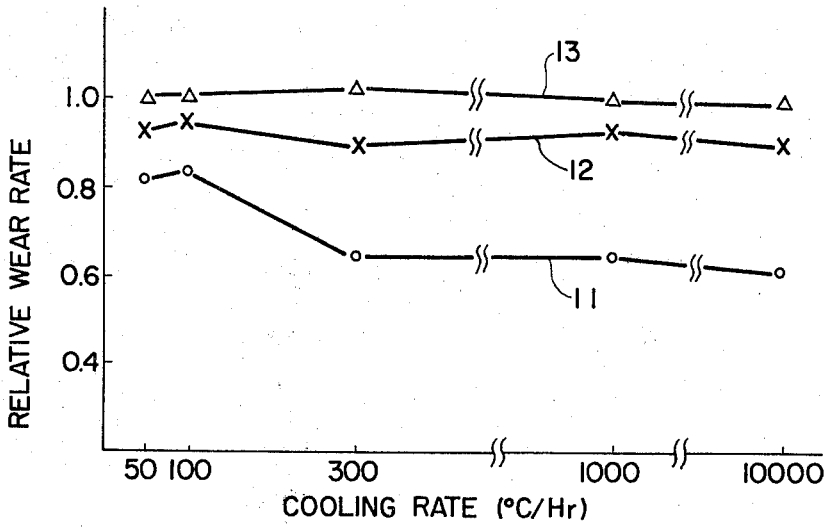
FIG. 3 is a chart showing the relation between the cooling rate after the heat-treatment and the abrasion quantity due to magnetic tapes in accordance with an embodiment of the present invention and the conventional alloy.

A Fe-Si-Al-Cr-Ti-P alloy consisting of 6.5% of Si, 9% of Al, 3% of Cr, 1% of Ti, 0.1% of P and the balance of Fe is melted and casted, and a rectangular plate sample having the same shape and size as that of the head core piece in Example 1 is cut out from the casted material and heat-treated at 1,000° C. for 2 hours in the hydrogen atmosphere. The sample is then cooled at varying cooling rates and subjected to measurement of the abrasion test using the magnetic tape. FIG. 3 illustrates the results of the test of these samples. In FIG. 3, curve 11 represents the result of the Fe-Si-Al-Cr-Ti-P alloy in accordance with the present invention and curves 12 and 13 represent the results of another alloy consisting of 6.5% of Si, 9% of Al, 6% of Cr and the balance of Fe (Fe-Al-Si-Cr alloy) and of an ordinary Fe-Al-Si sen-alloy (9.6% of Si, 5.4% of Al and the balance of Fe), respectively.

According to FIG. 3, it can be seen that the relative wear rate does not greatly depend on the cooling rate of 50°–10,000° C./hr in the case of Fe-Al-Si and Fe-Al-Si-Cr alloys, but the relative wear rate of the Fe-Al-Si-Cr-Ti-P alloy in accordance with the present invention becomes below a value of 0.8 at a cooling rate higher than 300° C./hr. When the cooling rate is as low as 50°–100° C./hr, the alloy of the invention exhibits a smaller abrasion rate than the Fe-Al-Si alloy and the Fe-Al-Si-Cr alloy, but its effect becomes remarkable when the cooling rate is higher than 300° C./hr. Incidentally, the experiment of the cooling rate at 10,000° C./hr is carried out by first keeping the sample at 1,000° C. and then withdrawing it from a furnace and quenching it.

EXAMPLE 6

Figure 4:
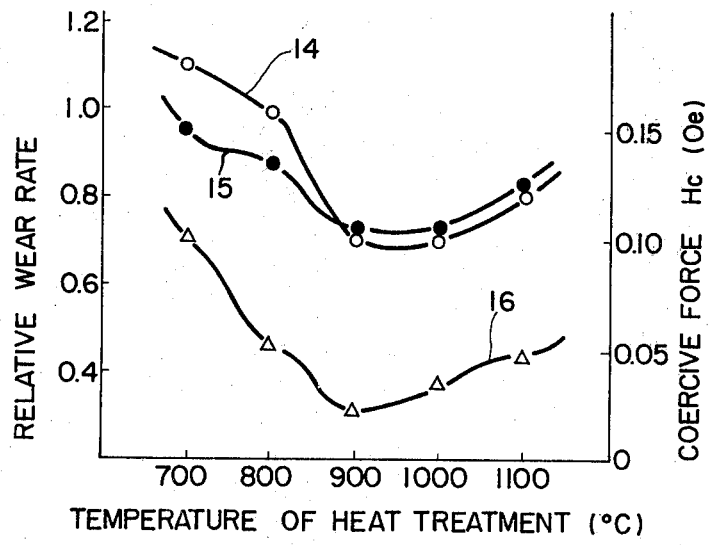
FIG. 4 is a chart showing the relation between the heat-treating temperature, the abrasive quantity due to the magnetic tape and the coercive force of the alloy of an embodiment of the present invention.

Abrasion quantity and coercive force due to a magnetic tape are measured for an alloy having the composition consisting of 7.5% of Si, 9% of Al, 3% of Cr, 1% of Ti, 0.1% of P and the balance of Fe, in the same way as in Example 1 except that the heat-treatment is carried out at 700°–1,100° C. for 1 hour (also, the cooling rate is 500° C./hr). Results of the measurement are shown in FIG. 4. In the drawing, curve 14 represents the result of the abrasion test. It can be seen that good abrasion resistivity, i.e., a wear rate of not more than 0.85, can be obtained when the heating temperature is from 900° C. to 1,100° C. The material is further heated at 900° C. and held at that temperature for 1 hour, followed by cooling at a cooling rate of 500° C./hr to obtain a sample. Curve 15 represents results of the abrasion test of this sample, while curve 16 represents results of the test of coercive force. When the heat-treating temperature is not higher than 800° C., the coercive force exceeds 0.05 Oersted. When the heat-treating temperature is higher than 1,200° C., the material exhibits the tendency of embrittlement, and is not much suitable for machining of a head. It is assumed that the embrittlement arises from oxidation or the like due to a trace amount of oxygen contained in the atmosphere of the heat-treatment. It is therefore preferred that the heat treatment be carried out at a temperature in the range of 850° C.–1,100° C. in order to improve the property of the high abrasion-resistive high permeability magnetic alloy in accordance with the present invention. Good results could be obtained if the heat-treating time in the above-mentioned heat treatment is from 0.5 to 3 hours. If the heat-treating time is shorter than 0.5 hours, stress relief becomes insufficient, and when it is longer than 3 hours, on the other hand, grain growth and oxidation of the material occur disadvantageously.

EXAMPLE 7

An alloy consisting of 7.5% of Si, 9% of Al, 3% of Cr, 1% of Ti, 0.1% of P and the balance of Fe is melted and casted in vacuum, from which a sample having the same shape and size as the piece of head core of Example 1 is cut out. The sample is heat-resisted at 1,000° C. for 1 hour in a hydrogen atmosphere and cooled at a rate of 500° C./hr. A magnetic head is produced from the sample in accordance with the ordinary process steps for producing the magnetic head. During gap forming, however, a 1 μm thick $SiO_2$ film is formed on the butt surface by sputtering and silver solder is used for bonding two core samples together to form the gap. The head is heated up to 1,000° C. and then cooled at a cooling rate of 500° C./hr. In this manner, there is obtained a magnetic head having a track width of 250 μm, a gap length of 1 μm and a gap depth of 50 μm. The optimum recording voltage is 45 V and the playback output voltage is 5.0 mV for this head. Hence, the head provides sufficient performance as a VTR head for broadcasting use. Moreover, as a result of the abrasion test using a magnetic tape ($\gamma$-$Fe_2O_3$ powder coated tape) used practically for broadcasting VTR at a room temperature of 25° C. and a humidity of 60%, the head is found to have service life of 1,500 hours. Thus, the head is confirmed to have drastically improved abrasion resistivity in comparison with the life of 500 hours of the conventional Fe-Al-Si sen-alloy.

EXAMPLE 8

An alloy consisting of 8% of Si, 9.5% of Al, 2% of Cr, 2% of Ti, 0.5% of C and the balance of Fe is melted and casted in vacuum, from which a rectangular plate sample having the same shape and size as a piece of the head core of Example 1 is cut out. The sample is heat-treated at 900° C. for 2 hours in the atmosphere of argon and cooled at a cooling rate of 10,000° C./hr (i.e., after the heat-treatment, the sample is withdrawn from the furnace and then cooled). A magnetic head is produced from this sample in accordance with the ordinary production steps of the magnetic head. In forming the gap, however, a 1 μm thick $SiO_2$ film is formed on the butt surface by sputtering, and bonding of the two cores for producing a core sample is made by use of Ag solder by heating up to 900° C. and then cooling at a cooling rate of 10,000° C./hr. There is thus obtained a head having a track width of 250 μm, a gap length of 1 μm and a gap depth of 50 μm.

The optimum recording voltage is 47 V and the playback output voltage is 4.7 mV for this head. Hence, the head exhibits sufficient performance as a VTR head for broadcasting. In addition, when this head is actually installed to a broadcasting VTR, its life is found to be 1,300 hours at a room temperature of 25° C. and a humidity of 60% as a result of the abrasion test using a magnetic tape, thus exhibiting drastic improvement in the abrasion resistivity in comparison with the conventional sen-alloy head whose life is 500 hours.

From the results mentioned above, it can be seen that heating and cooling for forming the gap of the magnetic head are substantially similar to those of the heat-treatment of the alloy.

As mentioned in the foregoing, the alloy in accordance with the present invention is much suited as an alloy for a magnetic head in its abrasion resistivity and magnetic performance.

Since numerous changes and different embodiments of the invention may be made without departing from the spirit and scope thereof, it is intended that all matter contained in the description shall be interpreted as illustrative and not in limiting sense.

What is claimed is:

1. Abrasion-resistive, high permeability magnetic alloy consisting of 6–9 wt.% of Si, 7–11 wt.% of Al, 2–5 wt.% of Cr, 0.5–2 wt.% of Ti, 0.02–0.3 wt.% of at least one member selected from the group consisting of P and C and the balance of Fe.

2. An abrasive-resistive, high-permeability magnetic alloy consisting essentially of 6–9 wt. % of Si, 7–11 wt. % of Al, 2–5 wt. % of Cr, 0.5–2 wt. % of Ti, 0.02–0.3 wt. % of at least one member selected from the group consisting of P and C, and the balance of Fe which has been heated at a temperature between 850° C. and 1,100° C. for 0.5–3 hours in a non-oxidizing atmosphere and then cooled at a cooling rate of at least 300° C./hr.

3. The abrasion-resistive, high permeability magnetic alloy as defined in claim 2 which has been cooled at a cooling rate of 300°–10,000° C./hour.

4. A magnetic head which comprises a core of an alloy, said alloy consisting of 6–9 wt. % of Si, 7–11 wt. % of Al, 2–5 wt.% of Cr, 0.5–2 wt.% of Ti, 0.02–0.3 wt.% of at least one member selected from the group consisting of P and C, and the balance of Fe.

* * * * *